US005960647A

United States Patent [19]

Fan

[11] Patent Number: 5,960,647

[45] Date of Patent: Oct. 5, 1999

[54] FOLDING-SHIFT MECHANISM FOR A BAG KNITTING APPARATUS

[76] Inventor: K. S. Fan, 73 King Hwa St., San Chung, Taiwan

[21] Appl. No.: 09/006,217

[22] Filed: Jan. 13, 1998

[51] Int. Cl.[6] ..... D06C 5/00

[52] U.S. Cl. ..... 66/151; 26/85; 493/447; 493/454; 493/458

[58] Field of Search ..... 66/150, 151, 152, 66/153; 242/539, 548, 548.2; 26/80, 84, 85; 493/447, 454, 458

[56] References Cited

U.S. PATENT DOCUMENTS

| | | | |
|---|---|---|---|
| 2,585,762 | 2/1952 | Gardner | 66/151 |
| 2,668,324 | 2/1954 | Johnson | 26/80 |
| 2,798,515 | 7/1957 | York | 26/80 |
| 3,616,502 | 11/1971 | Aronoff | 26/85 |
| 4,306,341 | 12/1981 | Rottensteiner | 26/80 |
| 4,865,579 | 9/1989 | Kirby et al. | 493/458 |
| 5,233,734 | 8/1993 | Strudel et al. | 26/80 |
| 5,575,162 | 11/1996 | Gray et al. | 66/151 |
| 5,598,614 | 2/1997 | Blanco | 26/85 |

*Primary Examiner*—Andy Falik
*Attorney, Agent, or Firm*—Bacon & Thomas

[57] ABSTRACT

A folding-shift mechanism for a bag knitting apparatus which folds inward the text-printed side portion of the knitted bag automatically to enhance the structural strength on both side portions and which overcomes the problem met in previous bag knitting apparatus in which the text-printed side portions can not be folded automatically. Therefore, the folding-shift mechanism for a bag knitting apparatus enhances the structural strength and production efficiency of the knitted bag. The folding-shift mechanism is arranged between a set of upper/lower rollers and comprises a pulley stage and a rotating-and-expanding frame. A front side of the pulley stage is provided with an expanding pulley. The rotating-and-expanding frame is provided with supporting rods which extend slantingly backward in right and left directions and a folding pulley arranged on the end of each supporting rod. The folding pulleys are positioned on a diagonal of the material strip of rectangular cross-section as the material strip is passed over the rotating-and-expanding frame to shift the folding of the material strip to a new folding line coincident with the diagonal. The orientation of the material strip can be redirected after passing over the rotating-and-expanding frame.

5 Claims, 4 Drawing Sheets

FOLDING-SHIFT MECHANISM FOR A BAG KNITTING APPARATUS

BACKGROUND OF THE INVENTION

In the conventional manufacturing process of a knitted bag, the raw material is firstly knitted into a double-layered material strip which has upper and lower layers and is seamless on both sides so as to form a tubular material strip. The double-layered material strip is then printed by techniques such as rolling, etc., sealed and cut into pieces, thus forming a knitted bag with two seamless sides.

In the above-manufactured knitted bag, the material should be printed with text on both sides and graph on its upper/lower surface before the sealing and cutting process. The printing process is carried out in such a way that the upper surface has been printed with text on one side (for example, the right side) and graph on another side (for example, the left side); and the lower surface has been printed in reversed order (that is, text on the left side and graph on the right side). Then the material strip is shifted such that the graphs are shifted to central portions of the upper/lower surface while one half of the text appears on each side of the upper/lower surface. Finally, the material strip, after the shift operation, is subjected to the sealing and cutting process to form the knitted bag.

In the above manufacturing steps, the printing of text and graph onto the material strip is not difficult; however, the shift process is cumbersome for the manufacturer. More particularly, to carry out the shift process, the folded material strip must first be unfolded and then the upper surface may be shifted laterally such that the graph is shifted to the central part and the text appears with one half on each side, while the lower surface is subjected to a similar shift process, but in reversed direction. After the shift process, the material strip is pressed to form a lamina-like strip with text and graph arranged in the desired position. The above-described shift process is carried out generally manually, thus being time-consuming and cumbersome.

SUMMARY OF THE INVENTION

The object of the present invention is to provide a folding-shift mechanism for a bag knitting apparatus which shifts the folding of the knitted bag automatically. The shift-folding mechanism according to the present invention is arranged between a set of upper and lower clamping rollers which have a predetermined distance therebetween. The printed material strip is first covered around the folding-shift mechanism and the folding shift process is accomplished by passing the material strip over the folding-shift mechanism.

The folding-shift mechanism comprises a pulley frame arranged between the upper and lower clamping rollers. A portion of the pulley frame between the upper and lower clamping rollers may have an upward-curved end to prevent it from falling. A front side of the pulley frame is provided with bearings for the arrangement of expanding pulleys which are rotatable and used to expand the material strip to a rectangular cross-section.

The folding-shift mechanism further comprises a rotating-and-expanding frame which includes a fixing shaft extending from the rear portion of the pulley frame, two supporting rods extending from both sides of the fixing shaft and a folding pulley arranged on each of the supporting rods, wherein the folding pulleys being placed on a diagonal of the rectangular cross-section of the material strip as it is passed over the expanding-and-rotating frame causes the material strip to be refolded with the diagonal as the folding line.

BRIEF DESCRIPTION OF THE DRAWINGS

In order to better understand the present invention, reference should be made to the following detailed description taken injunction with the accompanying drawings, wherein.

DETAILED DESCRIPTION OF THE PREFERRED EMBODIMENT

Figure 1:
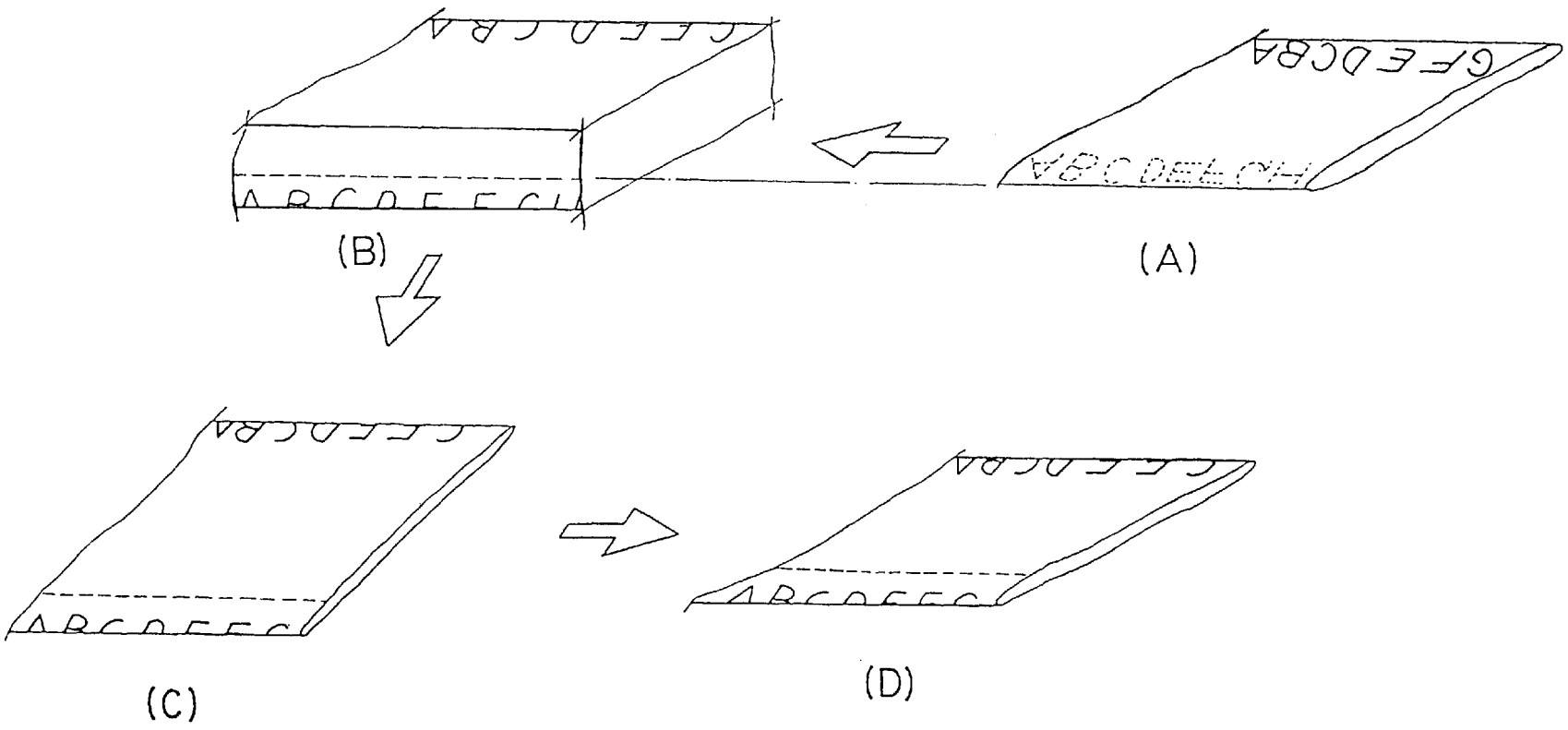
FIG. 1 shows the processing steps of the material strip according to the present invention, including: (A) knitting raw material into a double-layered material which is printed with text and graph; (B) separating upper and lower layers to form a rectangular cross-sectional shape; (C) slantingly pressing the expanded material along a new folding line consisting of a diagonal of the rectangular cross-sectional shape; and (D) guiding the material back to its original orientation for further processing.

FIG. 1 shows the processing steps of the material strip according to the present invention. More particularly, the raw material is knitted into a double-layered material strip which has upper and lower layers and is seamless on both sides (step A). Then the upper and lower layers are separated to a predetermined distance to form a rectangular cross-sectional shape (step B). The expanded material strip is, with its diagonal as a folding line, slantingly pressed into lamina-like material strip (step C). Finally, the material strip is guided to its original orientation (step D). Following the above steps, a portion of the upper surface will be shifted to the lower surface, and vice versa. Therefore, the material strip is shifted automatically.

Figure 2:
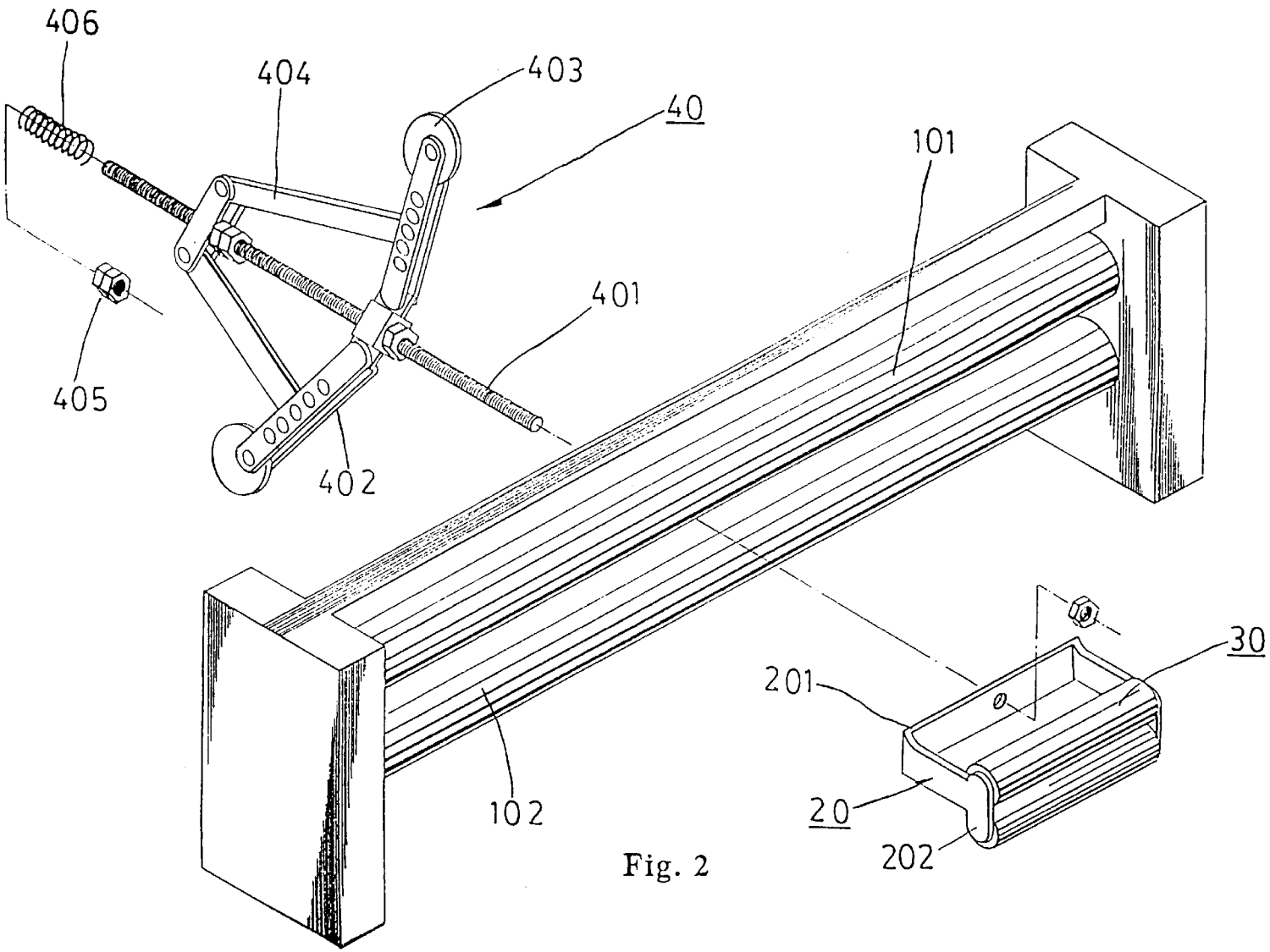
FIG. 2 shows an exploded view of the present invention.
Figure 3:
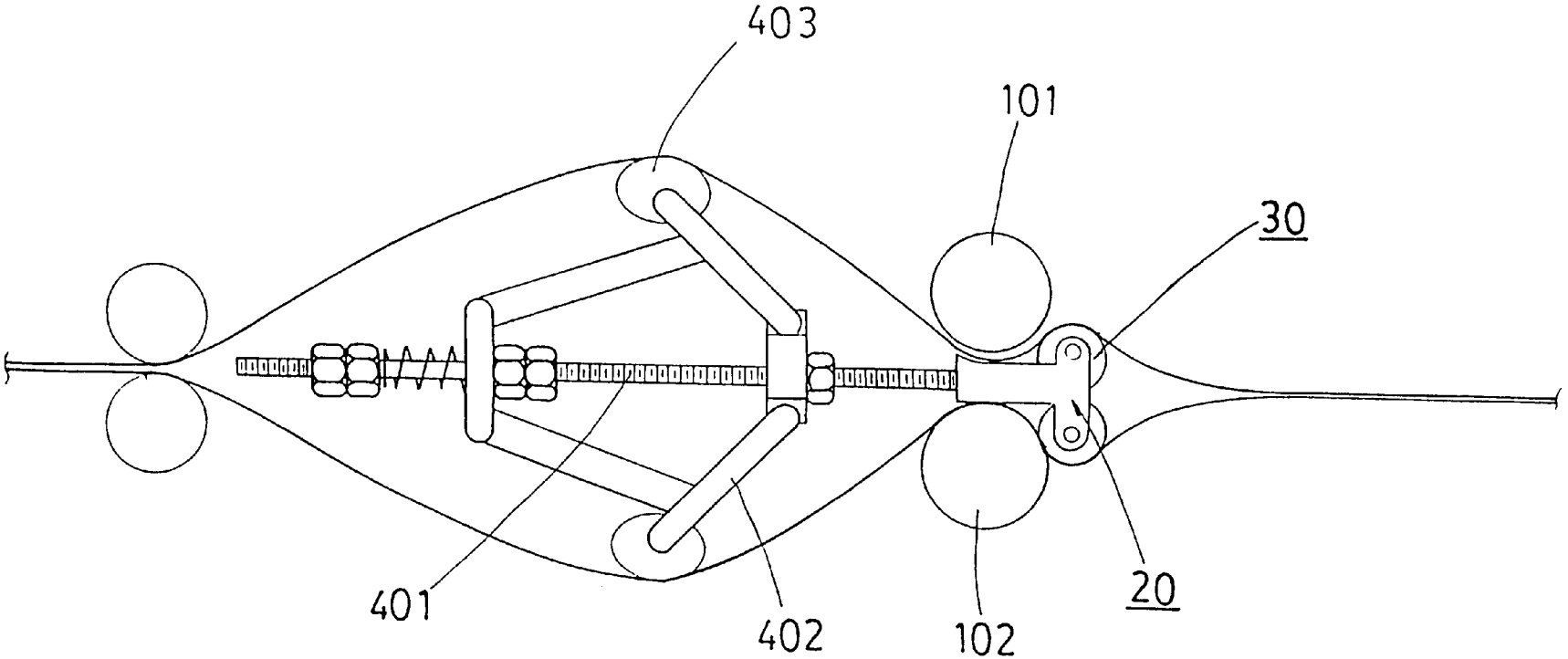
FIG. 3 shows the constructional relationship of the pulley frame and the upper/lower clamping rollers according to the present invention.

FIG. 2 shows the exploded view of the present invention. The folding-shift mechanism is arranged between a set of upper and lower clamping rollers (101) and (102) which have a predetermined distance therebetween. The printed material strip is first covered around the folding-shift mechanism and then follows the above steps B-D by passing thereover.

A pulley frame (20) is arranged in front of upper and lower clamping rollers (101) and (102). Between the upper and lower clamping rollers (101) and (102), in vertical direction, a rear portion (201) of the pulley frame (20) having an upward-curved end, to prevent it from falling, is positioned. The pulley frame (20) is detachable from the upper and lower clamping rollers (101) and (102) by lifting its front portion and applying a pushing force on the rear portion (201). The front portion of the pulley frame (20) is provided with bearings (202) for the arrangement of expanding pulleys (30) which are rotatable and used to expand the material strip to a rectangular cross-section (as shown in FIG. 1).

The folding-shift mechanism further comprises an expanding-and-rotating frame (40) including a fixing shaft (401) extending from the rear portion (201), two supporting rods (402) extending from both sides of the fixing shaft (40) and preferably oriented backward, and a folding pulley (403) arranged on each of the supporting rods (402), wherein the folding pulleys (403) being placed on a diagonal of the rectangular cross-section of the material strip as it is passed over the expanding-and-rotating frame (40) causes the material strip to be refolded with the diagonal as the folding line.

The material strip is thus shifted and thereafter may be conducted to its original orientation.

Figure 4:
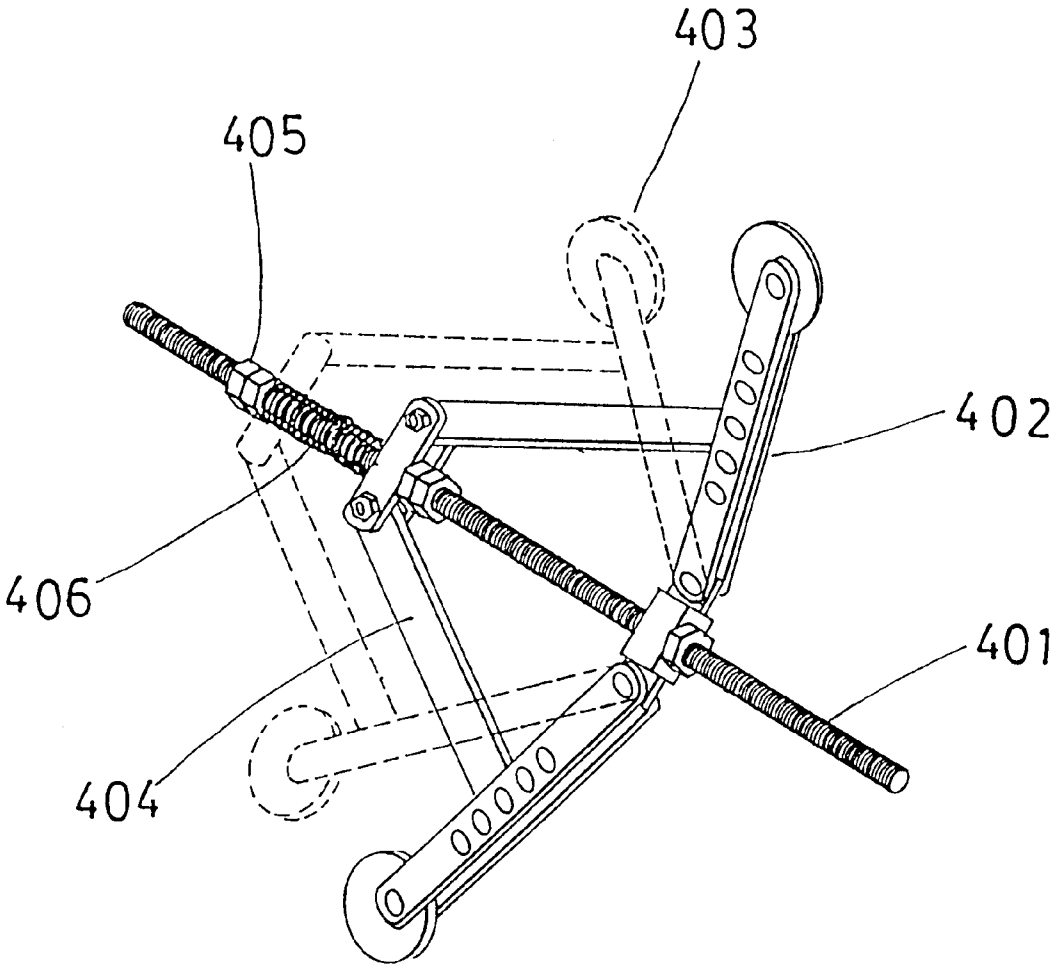
FIG. 4 shows the operation of the folding-shift mechanism according to the present invention.

As shown in FIG. 2 and FIG. 4, the above-mentioned expanding-and-rotating frame (40) has a front end of each supporting rod (402) fixed on a central portion of the fixing shaft (401). Also, a set of propping rods (404) are arranged on a rear side of the fixing shaft (401) through a coupling part (414) to prop each supporting rod (402). An adjusting knob (405) is arranged on the fixing shaft (401) ahead of the coupling part (414) to support the expanding-and-rotating frame (40) through spring (406) which biases the propping rods (404) to support the expanding-and-rotating frame (40) with a variable spreading angel. If the adjusting knob (405) is moved backward, the propping rods (404) may move further backward; accordingly, the variable spreading angle of the supporting rods (404) will be increased.

While this invention has been described in connection with what is presently considered to be the most practical and preferred embodiment, it is to be understood that the invention is not limited to the disclosed embodiment and has various modifications. Therefore, the present invention is intended to cover various modifications and equivalent arrangements included within the spirit and scope of the appended claims.

What is claimed is:

1. A folding-shift mechanism for a bag knitting apparatus which is arranged between an upper clamping roller and a lower clamping roller to shift a folding of a material strip, the upper and lower clamping rollers begin parallel and having a fixed separation, the folding-shift mechanism comprising:

a pulley frame arranged between the upper and lower clamping rollers, the pulley frame having a front portion arranged ahead of the rollers, the front portion having a bearing positioned on each side of the pulley frame, each of the bearings having one of a set of expanding pulleys arranged thereon, whereby the material strip is formed into a rectangular cross-section when it is passed over the pulley frame; and a rotating-and-expanding frame including a fixing shaft extending from a rear portion of the pulley frame, two supporting rods extending from the fixing shaft in left and right directions, and a folding pulley arranged on each of the supporting rods, whereby the folding pulleys being placed on a diagonal of the rectangular cross-section shifts the folding of the material strip to a folding line consisting of the diagonal when the material strip is passed over the rotating-and-expanding frame.

2. A folding-shift mechanism according to claim 1, further comprising:

an adjusting knob mounted on the fixing shaft, wherein the expanding-and-rotating frame has a variable spreading angle which is adjusted via the adjusting knob.

3. A method for shifting the folding of a materials strip comprising the steps of:

passing a material strip, which is folded along a first folding line, over a pulley frame to form a rectangular cross-section;

positioning a rotating-and-expanding frame on a diagonal of the rectangular cross-section; and passing the material strip over the rotating-and-expanding frame so positioned to shift the folding of the material strip to a second folding line coincident with the diagonal of the rectangular cross-section.

4. The method for shifting the folding of a material strip according to claim 3, further comprising the step of:

redirecting the material strip to orient the second folding line parallel to the first folding line.

5. The method for shifting the folding of a material strip according to claim 3, further comprising the step of:

adjusting a variable spreading angle of the rotating-and-expanding frame before passing the material strip thereover.

* * * * *